US007153105B2

(12) United States Patent
Koelzer et al.

(10) Patent No.: US 7,153,105 B2
(45) Date of Patent: Dec. 26, 2006

(54) COMPRESSOR WITH SWASH PLATE HOUSING INLET PORT

(75) Inventors: Robert L. Koelzer, Kearney, MO (US); Michael R. Jenkins, Kansas City, MO (US)

(73) Assignee: Haldex Brake Corporation, Kansas City, MO (US)

( * ) Notice: Subject to any disclaimer, the term of this patent is extended or adjusted under 35 U.S.C. 154(b) by 327 days.

(21) Appl. No.: 10/422,268

(22) Filed: Apr. 24, 2003

(65) Prior Publication Data

US 2004/0213678 A1 Oct. 28, 2004

(51) Int. Cl.
*F04B 1/26* (2006.01)

(52) U.S. Cl. ..... 417/53; 417/269; 91/12.2; 74/839

(58) Field of Classification Search ..... 417/222.1, 417/222.2, 269; 91/12.2; 74/839
See application file for complete search history.

(56) References Cited

U.S. PATENT DOCUMENTS

| | | | | | |
|---|---|---|---|---|---|
| 4,321,019 | A | | 3/1982 | Degawa et al. | 417/269 |
| 4,814,653 | A | | 3/1989 | Hasegawa et al. | 310/90 |
| 4,963,074 | A | | 10/1990 | Sanuki et al. | 417/222 |
| 5,113,670 | A | | 5/1992 | McAuliffe et al. | 62/402 |
| 5,394,698 | A | | 3/1995 | Takagi et al. | 60/438 |
| 5,626,463 | A | | 5/1997 | Kimura et al. | 417/269 |
| 5,752,413 | A | | 5/1998 | Kuhn et al. | 74/60 |
| 5,782,316 | A | * | 7/1998 | Kobayashi et al. | 184/6.17 |
| 6,162,024 | A | * | 12/2000 | Bruzek | 417/222.1 |
| 6,439,857 | B1 | | 8/2002 | Koelzer et al. | 417/222 |
| 6,443,711 | B1 | | 9/2002 | Miller | 417/372 |
| 6,883,416 | B1 | * | 4/2005 | Koelzer et al. | 92/12.2 |
| 2002/0048521 | A1 | | 4/2002 | Achtelik et al. | 418/47 |

* cited by examiner

*Primary Examiner*—Charles G. Freay
(74) *Attorney, Agent, or Firm*—St. Onge Steward Johnston & Reens LLC

(57) ABSTRACT

A compressor is disclosed generally comprising a cylinder block at least partially enclosing a compression chamber, a swash plate housing mounted adjacent the cylinder block, the swash plate housing at least partially enclosing a swash plate chamber, an inlet port in the swash plate housing, and a passageway connecting the swash plate chamber and compression chamber. In certain embodiments, the passageway comprises a fluid channel in the cylinder block. In some embodiments, at least one bearing is disposed in the swash plate chamber such that air entering through the inlet port flows over the bearing before flowing to the compression chamber.

20 Claims, 6 Drawing Sheets

COMPRESSOR WITH SWASH PLATE HOUSING INLET PORT

FIELD OF THE INVENTION

The present invention relates to a method and apparatus for generating compressed air. More specifically, the invention relates to a compressor for motor vehicles employing an inlet port in a swash plate housing.

BACKGROUND OF THE INVENTION

Swash plate compressors are generally known in the art. These compressors typically employ a cylinder block with a plurality of piston channels mounted on a drive shaft. A plurality of pistons are slidably disposed in the piston channels and are coupled to a swash plate that is also mounted on the drive shaft. In accordance with the rotation of the drive shaft, the swash plate pivots, causing reciprocal motion of the pistons within the piston channels, thereby alternately creating suction and compression strokes.

These compressors employ a variety of mechanisms that utilize the rotational force of the drive shaft to make the swash plate pivot, such as an actuating assembly with a slanted surface underneath the swash plate, as disclosed in U.S. Pat. No. 6,439,857 to Koelzer, which is assigned to the assignee of the present application, an assembly of rotating and non-rotating plates, as disclosed in U.S. Pat. No. 5,626,463 to Kimura, and a rotatable cylinder block, as disclosed in U.S. Pat. No. 5,394,698 to Takagi. As the swash plate pivots, the pistons reciprocate within the piston channels of the cylinder block, alternately drawing fluid to be compressed into the channels and subsequently compressing and discharging the fluid, all of which are hereby incorporated herein by reference.

In this way, the rotational force of the shaft is converted into axial motion of the pistons, enabling the pistons to alternately perform the functions of suction and compression, and thus, fluid is first drawn into a piston channel and is subsequently compressed and discharged from the piston channel.

In order to permit fluid to be drawn into, and subsequently discharged from, the piston channels, these compressors typically include a compressor head having inlet and outlet valves, or separate valve plates disposed between the compressor head and the cylinder block having such valves, which regulate the inflow and outflow of the fluid. These valves permit the piston channels to communicate with inlet and outlet channels, and ultimately, inlet and outlet ports, in the compressor head.

One disadvantage of these compressors, however, is that they must facilitate both the entry of uncompressed fluid from the compressor head in one direction and the discharge of compressed fluid to the compressor head in the opposite direction. Therefore, the compressor head must be designed with both inlet and outlet ports in the compressor head that each exclusively communicate with corresponding channels and valves, in order to permit the fluid to alternately flow in opposite directions and prevent the backfeeding of this fluid. Such assemblies tend to be difficult and costly to manufacture, and further, often entail multiple parts that are difficult to assemble.

Another disadvantage of these compressors is that the swash plate assemblies typically include at least one bearing facilitating the translation of the rotational motion of the drive shaft to the axial motion of the pistons within the piston channels. Such bearings may include, for example, a bearing coupling an inner part of the swash plate, which rotates with the drive shaft, and an outer part of the swash plate, which is coupled to the pistons, such as the assembly disclosed in U.S. Pat. No. 6,439,857 to Koelzer. Similarly, such bearings may include a bearing by which the pistons are coupled to the swash plate, or a bearing by which another device that facilitates the efficient operation of the swash plate is coupled thereto.

In order to overcome this disadvantage, it has been proposed to use a swash plate compressor having a cylinder block defining a swash plate chamber therein, the cylinder block having an inlet port that permits a fluid to flow into the swash plate chamber and cool the bearings therein, such as the compressor disclosed in U.S. Pat. No. 4,963,074 to Sanuki. Such compressors employing an inlet port in the cylinder block, however, suffer from several disadvantages. First, because the path of air flowing through the inlet port intersects with the piston channel, the port is often obstructed. Moreover, the fluid must pass over the inner walls of the cylinder block, which obviously have been heated due to the frictional force resulting from the pistons reciprocating in the piston channels, thereby increasing the temperature of the fluid and decreasing its ability to cool the bearings in the swash plate chamber.

What is desired, therefore, is a method and apparatus for compressing fluid that employs an arrangement for receiving and discharging fluid that is not complex. What is further desired is a method and apparatus that permits the fluid to be compressed to also be used to cool at least one of the bearings employed by the apparatus.

SUMMARY OF THE INVENTION

Accordingly, it is an object of the present invention to provide a compressor that has an arrangement for receiving and discharging fluid that is inexpensive to manufacture.

It is a further object of the present invention to provide a compressor that has an arrangement for receiving and discharging fluid that is easy to assemble.

It yet another object of the present invention to provide a compressor that permits the fluid to be compressed to also be used to cool at least one of the bearings in the compressor.

In order to overcome the deficiencies of the prior art and to achieve at least some of the objects and advantages listed, the invention comprises a compressor including a cylinder block, the cylinder block at least partially defining a compression chamber, a swash plate housing mounted adjacent to the cylinder block, the swash plate housing at least partially defining a swash plate chamber, an inlet port in the swash plate housing through which fluid enters the swash plate chamber without passing through any part of any cylinder block, and a passageway by which the swash plate chamber communicates with the compression chamber.

In another embodiment, the invention comprises a compressor including a cylinder block at least partially defining a compression chamber and having at least one piston channel therein, a swash plate housing mounted adjacent to the cylinder block, the swash plate housing at least partially defining a swash plate chamber, an inlet port in the swash plate housing through which fluid enters the swash plate chamber without passing through any part of any cylinder block, a passageway by which the swash plate chamber is in fluid communication with the compression chamber, through which the fluid in the swash plate chamber flows to the compression chamber, a shaft disposed in the swash plate housing and cylinder block, a swash plate mounted on the shaft, at least one piston coupled to the swash plate and disposed in the at least one piston channel and slidable therein, and an actuator contacting the swash plate, such that the actuator, in a first position, exerts a force on the swash plate appropriate to retain the swash plate in a position perpendicular to the drive shaft, such that the at least one piston remains idle, and, in a second position, exerts a force on the swash plate appropriate to pivot the swash plate, thereby causing reciprocal motion of the at least one piston.

In yet another embodiment, the invention comprises a method of compressing fluid with a compressor having a cylinder block at least partially defining a compression chamber and a swash plate housing at least partially defining a swash plate chamber, the method including receiving the fluid in the swash plate chamber, cooling a bearing in the swash plate chamber with the received fluid, communicating the fluid to the compression chamber, compressing the fluid in the compression chamber, and discharging the fluid to a vehicle's air system.

DETAILED DESCRIPTION OF THE DRAWINGS

Figure 1:
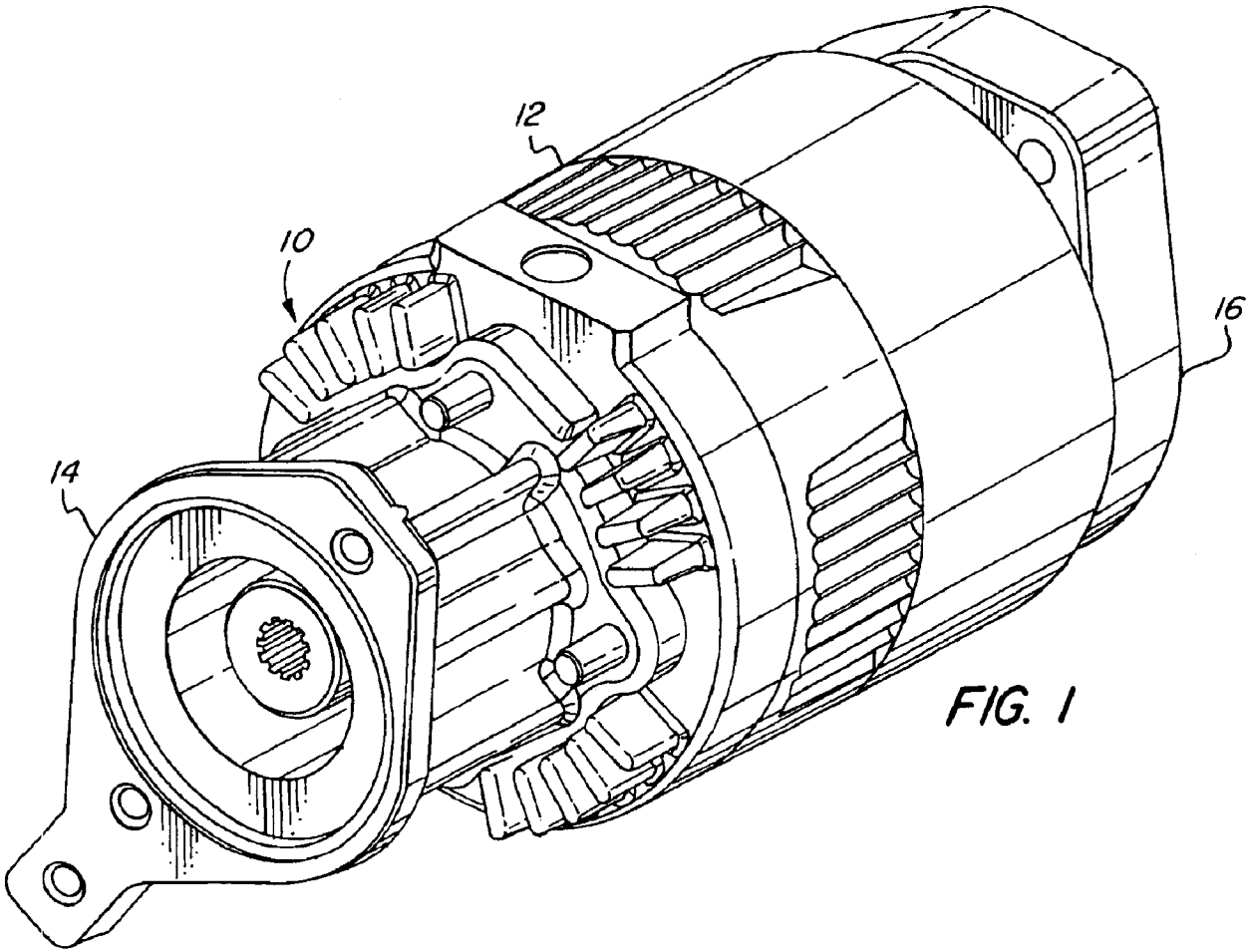
FIG. 1 is an isometric view of a swash plate compressor in accordance with the invention.

The basic components of one embodiment of a swash plate compressor 10 in accordance with the invention are illustrated in FIG. 1. As used in the description, the terms "top," "bottom," "front," "rear," "up" and "down" refer to the objects referenced when in the orientation illustrated in the drawings, which orientation is not necessary for achieving the objects of the invention.

Typically, the compressor 10 includes a main body 12, a rear mounting cover 14, and a front mounting flange 16. When in use, the compressor 10 is installed on a vehicle, such as an over-the-road truck, and generates compressed air for the vehicle's pressure system, which typically includes a tank (not shown) that supplies the compressed air to various accessories, such as, for example, the brake system. This production of the compressed air begins by receiving air, which may or may not be delivered from a turbocharger (not shown), in response to a reduction of the air pressure in the air system to or below a reference pressure. Though, in the embodiment described herein, the fluid is air, in certain other embodiments, the fluid may comprises any of various gases, liquids, or mixtures thereof.

Figure 2:
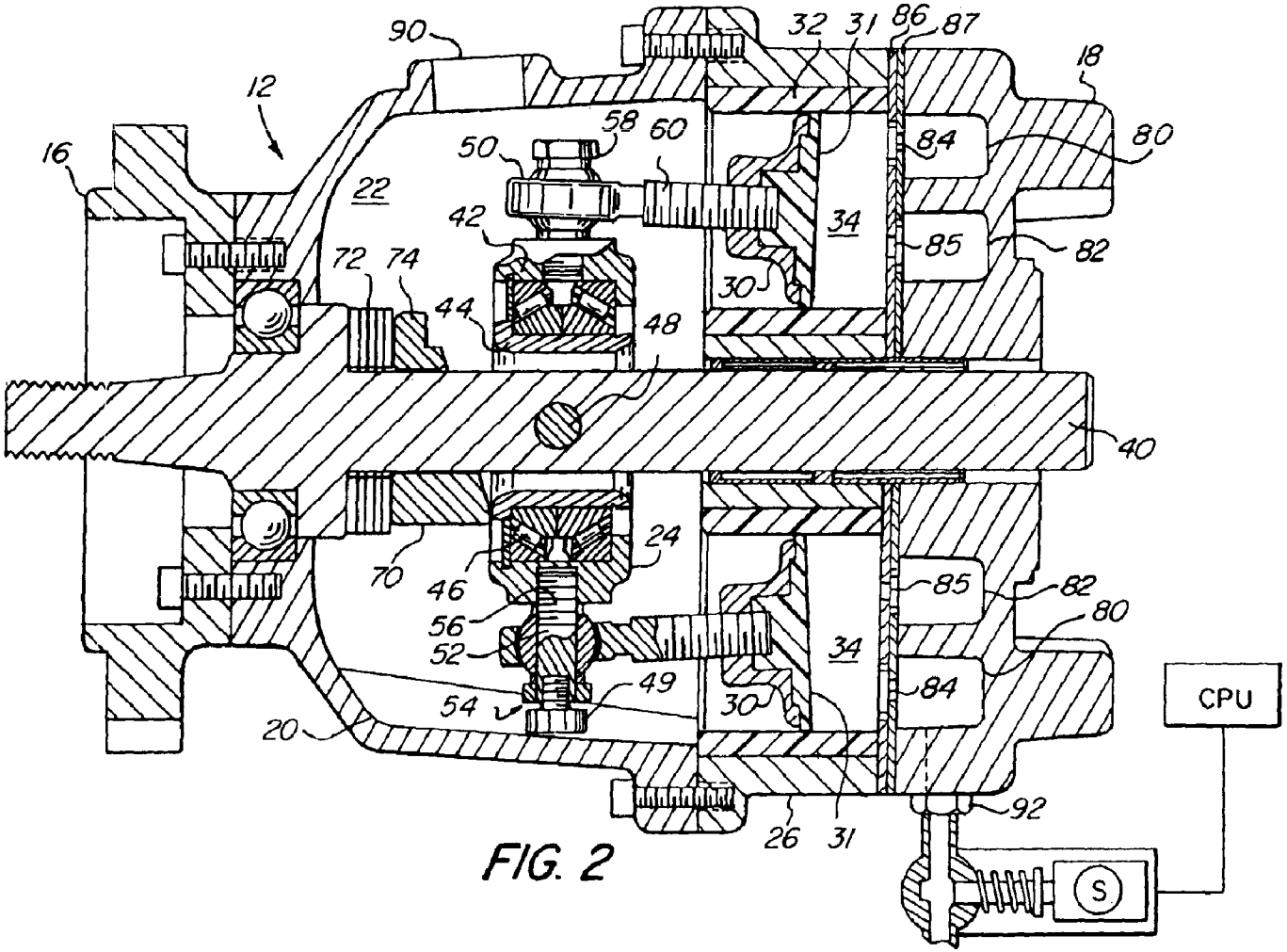
FIG. 2 is a cross-sectional side view of the compressor of FIG. 1.
Figure 3:
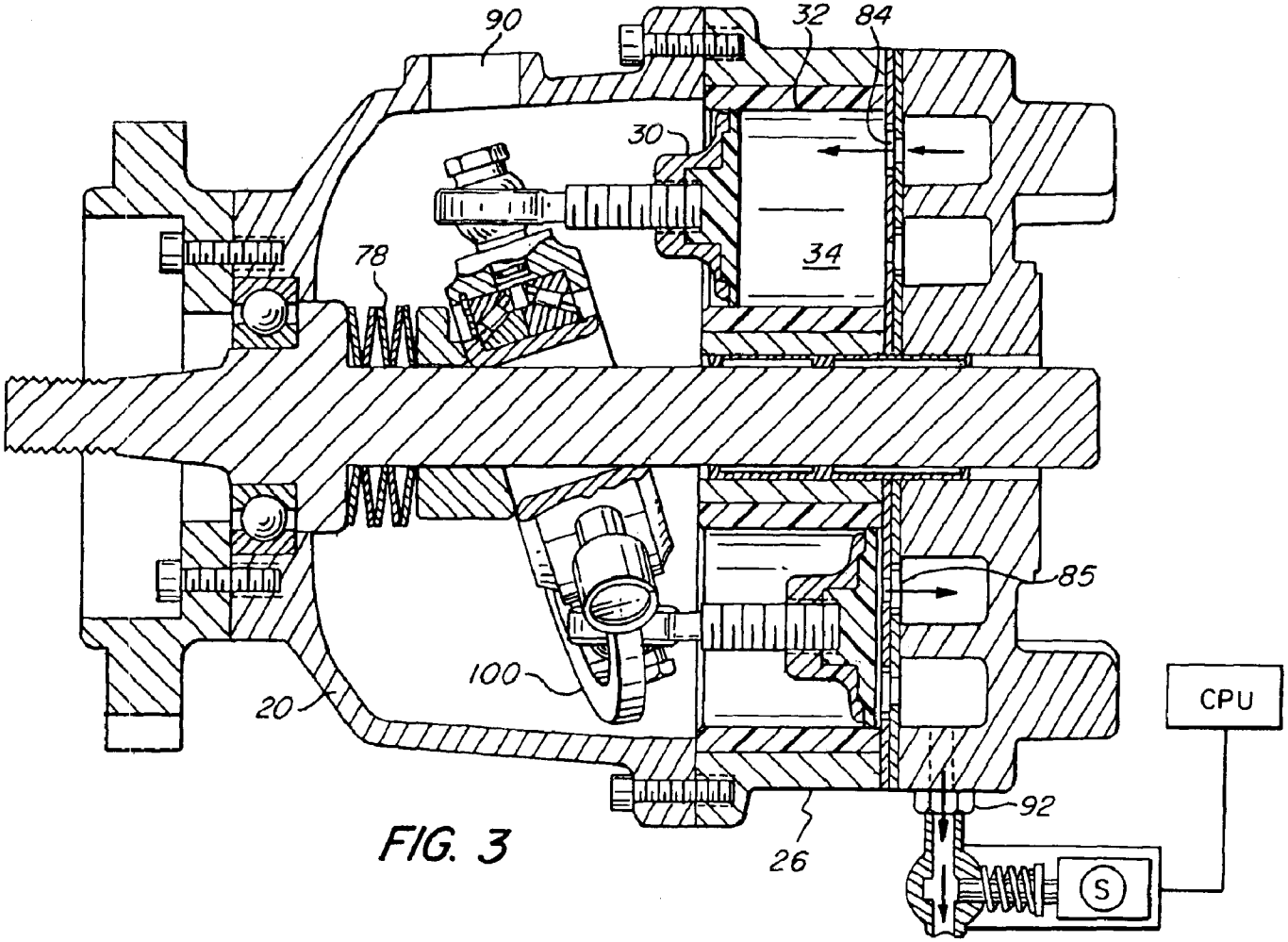
FIG. 3 is a cross-sectional side view of another embodiment of the compressor of FIG. 1.

The basic components of one embodiment of the main body 12 of the compressor 10 are illustrated in FIGS. 2–3. The main body 12 includes a swash plate housing 20 defining a swash plate chamber 22 therein, and a stationary cylinder block 26 mounted to the housing 20. A drive shaft 40 extends through both the housing 20 and the cylinder block 26 and is rotatable therein. A swash plate 24 is disposed in the swash plate chamber 22 and mounted on the shaft 40. A plurality of pistons 30 are coupled to the swash plate 24, and the cylinder block 26 has a plurality of piston channels 32 that receive the pistons 30. The pistons 30 are reciprocally displaceable within the piston channels 32 in order to produce suction and compression strokes.

Each piston 30 has a face 31 for contacting the air to be compressed. Accordingly, a compression chamber 34 is formed from the space in the piston channel 32 to which the piston face 31 is exposed. The compression chamber 34, which is in fluid communication with the air system, both receives air to be compressed and discharges air after compressing it. Accordingly, the air pressure in the compression chamber 34 corresponds to the air pressure in the air system, thereby ensuring a state of pressure equilibrium for the compressor 10, as is further explained below.

In the embodiment described herein, the swash plate 24 has an outer part 42 and inner part 44, wherein the outer part 42 is coupled to the inner part 44 via a bearing 46. The inner part 44 is mounted on the shaft 40 with a pin 48, such that the inner part 44 rotates with the shaft 40. As the shaft 40 rotates, the bearing 46 permits the outer part 42 of the swash plate 24 to be restrained as the inner part 44 rotates with the shaft 40. Accordingly, the outer part 42, the pistons 30, and the cylinder block 26 can all be non-rotating. With this arrangement, the shaft 40 can continue to rotate even when the compressor 10 is not compressing air, and the pistons 30 are idle. As a consequence, accessories coupled to the shaft 40, such as, for example, a fuel pump (not shown), continue to function.

In certain embodiments, in order to prevent the outer part 42 from rotating, the swash plate 24 receives a radially extending stopper 49 that engages an axial groove of the housing 20, as shown in FIG. 2. In other embodiments, as shown in FIG. 3, a gimbal arm 100 may be used to prevent the outer part 42 from rotating.

To facilitate the reciprocal motion of the pistons 30 within the piston channels 32, the entire swash plate 24 is pivotal with respect to the shaft 40. In order to translate the pivotal displacement of the swash plate 24 about the shaft 40 to reciprocal displacement of the pistons 30 parallel to the axis of the shaft 40, the pistons 30 are coupled to the swash plate 24 via a bearing 50. In the embodiment described herein, the outer part 42 of the swash plate 24 includes a plurality of ball links, each of which is comprised of a swash plate rod 52 and a ball element 54. In certain embodiments, the rods 52, which are typically spaced angularly equidistantly from one another along an outer periphery of the swash plate 24 and extend radially therefrom, are bolts having a thread 56 on one end, which is screwed into the swash plate 24, and a nut 58 on the opposite end. The ball element 54 has a spherical outer surface for slidably engaging a piston rod 60, which extends parallel to the rotating shaft 40, in order to permit axial displacement of the piston rod 60 while allowing the ball element 54 and the piston rod 60 to be angularly displaced relative to one another.

In the embodiment depicted herein, an actuator 70 is provided for effecting the pivotal displacement of the swash plate 24. The pistons 30 remain idle in a state of pressure equilibrium when a piston-generated force acting upon the swash plate 24 and corresponding to the air pressure in the compression chambers 34 above the pistons 30 is equal and oppositely directed to a thrust generated by the actuator 70 against the swash plate 24. This state of equilibrium occurs when the swash plate 24 is in a substantially perpendicular position with respect to the axis of a drive shaft 40. Once the balance of air pressure has been disturbed, the thrust from the actuator 70 exceeds the lowered piston-generated force to angularly displace the swash plate 24 from its perpendicular position. As a result, the pistons 30 begin to reciprocally move in the piston channels 32. Thus, the more the air pressure in the air system drops, the larger the angular displacement of the swash plate 24 and the longer the strokes of the pistons 30 within the piston channels 32.

The swash plate 24 pivots about the pin 48 upon the thrust exerted by the actuator 70. In certain advantageous embodiments, the actuator 70 includes a resilient element 72, such as, for example, Belleville washers, and a cam collar 74. The washers 72 are connected to the cam collar 74, which has a slanted cam surface with respect to the shaft 40, an extended part of which is always in contact with the swash plate 24. The swash plate 24 is always under pressure existing above the pistons 30, and thus, in order to maintain the swash plate 24 in a position perpendicular to the shaft 40 during the state of equilibrium, the cam collar 74 must continuously preload the swash plate 24. However, this contact in the state of equilibrium does not generate a thrust sufficient to overcome the pressure above the pistons 30 and pivot the swash plate 24. In operation, the washers 72 expand in response to the pressure drop in the air system to or below the reference value. As a result, the cam collar 74 is axially displaced to pivot the swash plate 24, the movement of which generates the suction and compression strokes of the pistons 30.

Although the actuator 70 is shown rotatably mounted on the shaft 40, in certain embodiments, the actuator 70 can be mounted on the housing 20. Further, in certain embodiments, other types of resilient elements, such as different types of compression springs 78, such as, for example, bellows, are used instead of the Belleville washers described above. In other embodiments, the actuator includes a servo piston (not shown), which is actuated in response to a pilot signal representing the reference value of the air system's pressure and generated by an external source once the pressure falls down to or below the threshold. In such embodiments, the servo piston, which is attached to a mechanical link such as a fork, displaces the cam collar 74 to exert a thrust to pivotally displace the swash plate 24.

Typically, the main body 12 of the compressor 10 further includes a compressor head 18 mounted adjacent to the cylinder block 26. The compressor head has an inlet channel 80 and an outlet channel 82 that are both in communication with the compression chambers 34. In order to regulate the entry of uncompressed air from the inlet channel 80, and the discharge of compressed air to the outlet channel 82, and to prevent the back-feeding of this air, the compressor 10 is typically provided with a plurality of inlet and outlet valves 84, 85. The valves 84, 85, which are often one-way reed or poppet valves, allow air to flow along a path from a high-pressure area to a low-pressure area, and are typically part of the compressor head 18, or are created using valve plates 86, 87 disposed between the compressor head 18 and the cylinder block 26.

The compressor head 18 is provided with an outlet port 92 in communication with the outlet channel 82. Accordingly, once compressed air is discharged from the compression chambers 34 through the outlet valves 85, the air may be directed to the air system via the outlet port 92. The swash plate housing 20 is provided with an inlet port 90, thereby eliminating the need for the compressor head 18 to have both an inlet port and an outlet port in fluid communication with the inlet channel 80 and the outlet channel 82, respectively, one of which runs along the outer periphery of the compressor head 18, and the other of which runs around the center of the compressor head 18, as explained further below.

Figure 4:
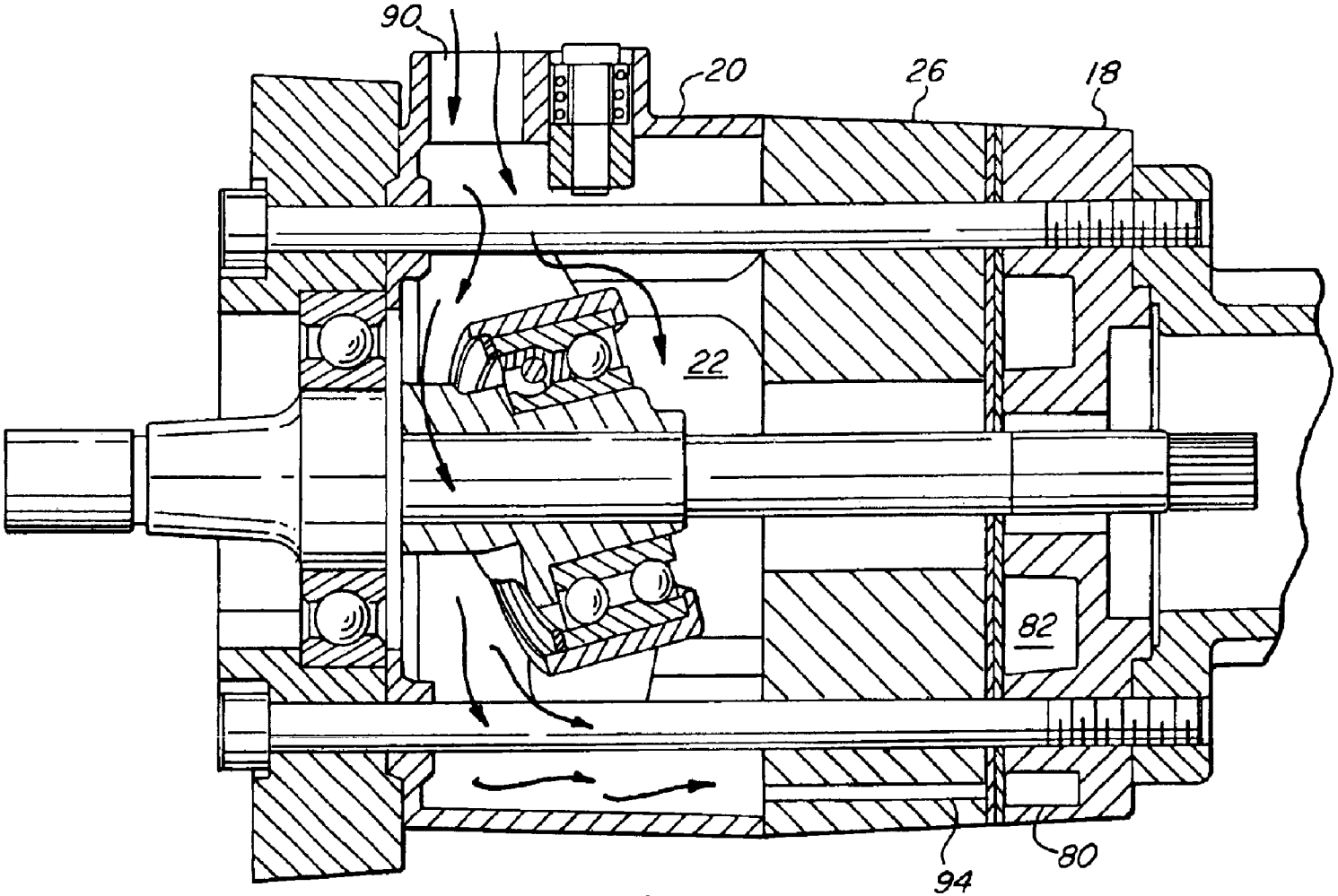
FIG. 4 is another cross-sectional view of the compressor of FIG. 3.
Figure 6:
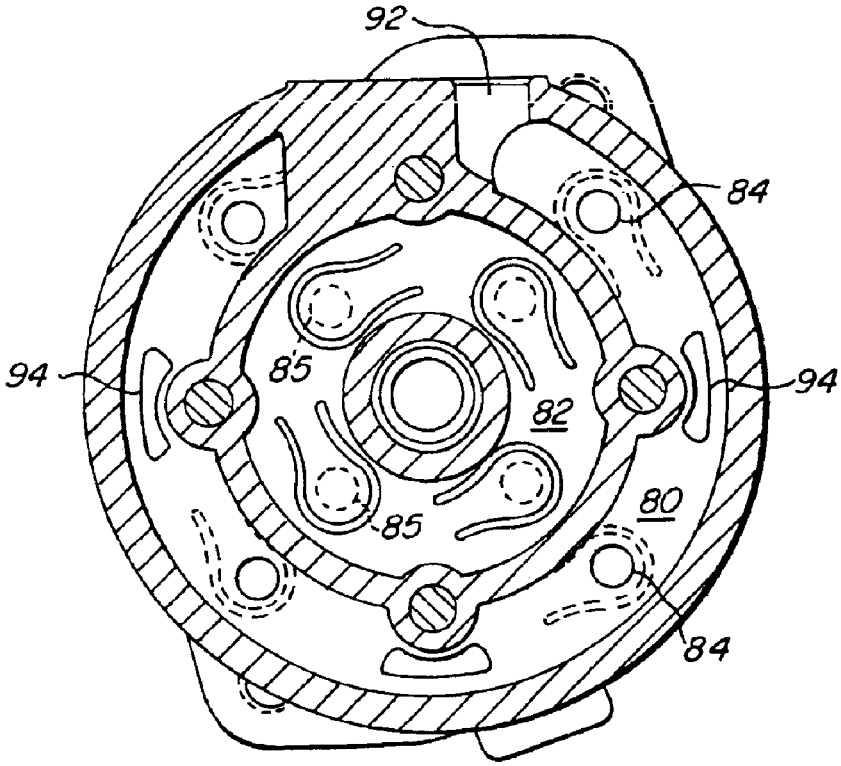
FIG. 6 is a top cross-sectional view of the cylinder block of the compressor of FIG. 4.
Figure 5:
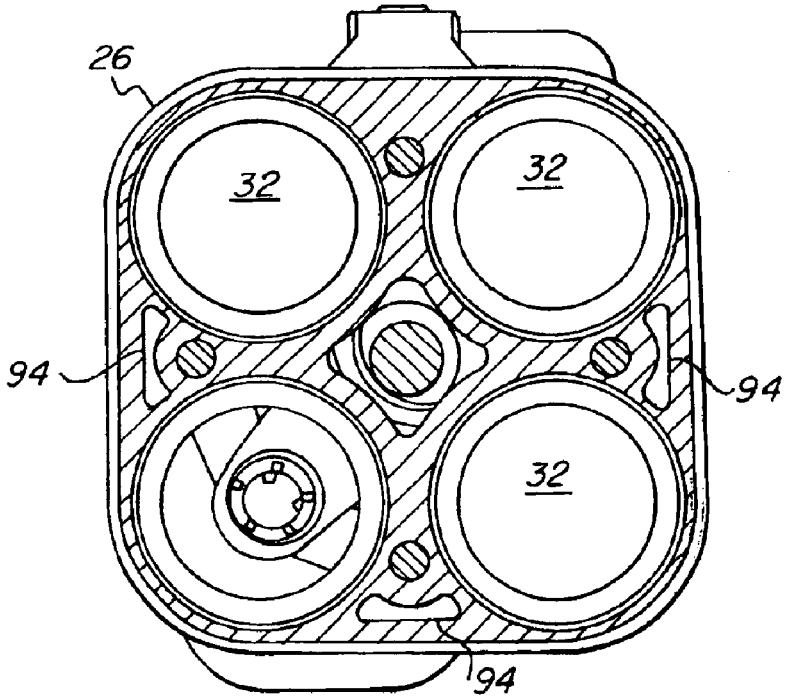
FIG. 5 is a top cross-sectional view of the compressor head of the compressor of FIG. 4.

As illustrated in FIG. 4, via the inlet port 90, air is able to enter the swash plate chamber 24. At least one passageway 94 is provided for allowing the air to flow from the swash plate chamber 22 to the compression chamber 34. In certain advantageous embodiments, this is accomplished by providing a plurality of fluid channels 94 in the cylinder block 26, as shown more clearly in FIG. 5. As illustrated in FIG. 6, the fluid channels 94 are in fluid communication with the inlet channel 80, which, in turn, is in communication with the compression chambers 34 via the inlet valves 84. In this way, the swash plate chamber 22 is in fluid communication with the compression chambers 34.

Figure 7:
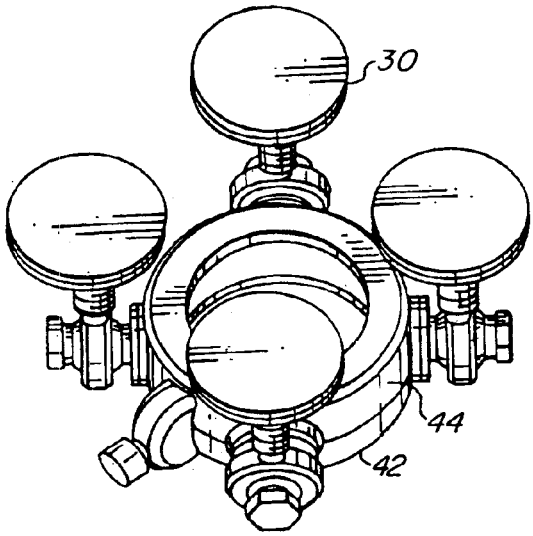
FIG. 7 is a isometric view of the swash plate of the compressor of FIG. 4.
Figure 8:
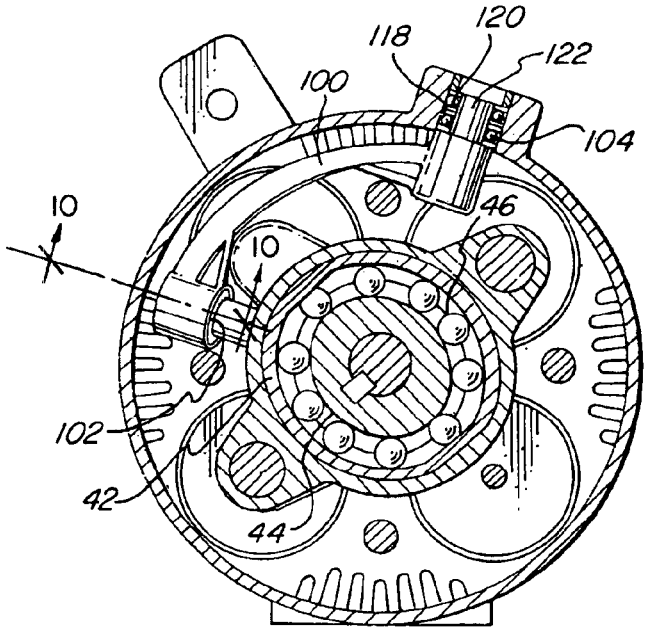
FIG. 8 is an bottom cross-sectional view of a swash plate bearing of the compressor of FIG. 4.

This arrangement is particularly useful because various types of bearings are typically employed in order to operate the compressor 10 effectively and efficiently. As shown more clearly in FIG. 7, one such bearing may be the bearing 46, mentioned above, by which the outer, non-rotating part 42 of the swash plate 24 is coupled to the inner, rotating part 44. Bearing 46 could take any of various forms. For example, as illustrated in FIG. 8, the bearing 46 could be a ball bearing or a roller bearing located along the outer periphery of the inner part 44 and the inner periphery of the outer part 42. In other embodiments, the bearing may simply be formed from a race (not shown) in one of the inner or outer parts 44, 42, with which race a portion of the outer or inner part 42, 44, respectively, engages.

Figure 9:
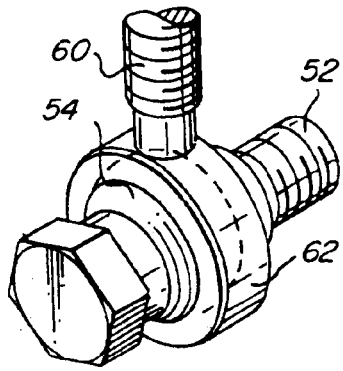
FIG. 9 is an isometric view of a swash plate-piston rod bearing of the compressor of FIG. 4.

Another bearing typically employed in order to operate the compressor 10 may be the bearings 50, mentioned above, by which the swash plate 24 is coupled to the pistons 30. Each bearing 50 could take any of various forms, such as, for example, a flange 62 of the piston rod 60, the inner surface of which cooperates with an outer extremity of the ball element 54, as illustrated in FIG. 9. Accordingly, as the swash plate 24 is angularly displaced from a position perpendicular to the drive shaft 40, the cooperating surfaces of the ball element 54 and flange 62 slide relative to one another. Such relative displacement allows the piston rod 60 and ball element 54 to move axially together, while the ball element 54 rotates within the flange 62 in response to the angular motion of the swash plate 24. Though the cooperating surfaces of the ball element 54 and flange 62 are depicted as annular, in certain embodiments, other shapes that move synchronously while being angularly displaced relative to one another may be used. Alternatively, in other embodiments, the bearing 50 may take other forms, such as, for example, bearings similar to those described above.

Figure 10:
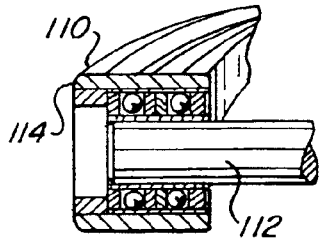
FIG. 10 is an isometric view of a gimbal arm bearing of the compressor of FIG. 4.

Yet another bearing that may be employed in order to operate the compressor 10 efficiently is a gimbal arm bearing. As mentioned above and shown more clearly in FIGS. 8 and 10, in certain embodiments, a gimbal arm 100 is simultaneously connected to the swash plate 24 by a first rotatable joint 102 and to the swash plate housing 20 via a second rotatable joint 104 to prevent the outer part 42 of the swash plate 24 from rotating. By permitting the gimbal arm 100 to rotate about two perpendicular axes via the joints 102, 104, the swash plate 24 is free to pivot about the pin 48 in any radial direction, and thus, the swash plate 24 is never restrained from pivoting as the actuator 70 continually exerts a thrust upon the swash plate 24 throughout the course of a full three hundred and sixty degree rotation. However, because the gimbal arm 100 is able to rotate along only these two rotational axes, it does not rotate along the rotational axis that is perpendicular to these two axes—i.e. the rotational axis of the drive shaft 40. As a result, the gimbal arm 100 prevents the swash plate from rotating along the rotational axis of the drive shaft 40, and thus, restrains the swash plate 24 from rotating with the shaft 40.

In order to permit rotation, each of the joints 102, 104 typically includes at least one roller bearing 110 and a journal 112 disposed therein. These joints may take various forms. For example, a journal cap 114 may include the roller bearing 110. Hence, the journal 112, which is coupled with, connected to, or an integral part of, the swash plate 24 or housing 20, is rotatably disposed in the journal cap 114. Alternatively, a cavity 118 in the housing 20 or swash plate 24 may include a roller bearing 120 and thus, a journal 122 is rotatably disposed in the cavity 118 to create the joint 104.

As illustrated in FIGS. 3–4, in operation, air enters the compressor 10 via the inlet port 90. The air flows into the swash plate chamber 22 unheated by the cylinder block 26, which is mounted adjacent the separate swash plate housing 20. The air flows over the various bearings discussed above, thereby cooling them and countering at least some of the heat produced by these moving parts. The air then flows into the fluid channels 94 and into the inlet channel 80 in the compressor head 18. From here, the air flows through the inlet valves 84 and into the compression chambers 34. As the pistons 30 move though the piston channels 32, the air is compressed and discharged through the outlet valves 85 and into the outlet channel 82. From here, the air exits the compressor 10 via the outlet port 92 and flows to the air system.

It should be understood that the foregoing is illustrative and not limiting, and that obvious modifications may be made by those skilled in the art without departing from the spirit of the invention. Accordingly, reference should be made primarily to the accompanying claims, rather than the foregoing specification, to determine the scope of the invention.

What is claimed is:

1. A compressor, comprising:

a cylinder block at least partially defining a compression chamber;

a swash plate housing mounted adjacent to said cylinder block, said swash plate housing at least partially defining a swash plate chamber;

a fluid inlet port in said swash plate housing through which fluid enters the swash plate chamber without passing through any part of any cylinder block;

a passageway by which the swash plate chamber is in fluid communication with the compression chamber, through which the fluid in the swash plate chamber flows to the compression chamber;

at least one bearing positioned in the swash plate chamber such that fluid flows through said inlet port, into the swash plate chamber and over said bearing, through said passageway, and into the compression chamber;

a swash plate disposed in the swash plate chamber, wherein said swash plate comprises:

a rotatable inner part; and a non-rotatable outer part coupled to said inner part by at least one of said bearings.

2. The compressor as claimed in claim 1, wherein said bearing comprises a race.

3. The compressor as claimed in claim 1, wherein said bearing comprises a ball bearing.

4. The compressor as claimed in claim 1, wherein said bearing comprises a roller bearing.

5. A compressor comprising:

a cylinder block at least partially defining a compression chamber;

a swash plate housing mounted adjacent to said cylinder block, said swash plate housing at least partially defining a swash plate chamber;

a fluid inlet port in said swash plate housing through when fluid enters the swash plate chamber without passing through any part of any cylinder block;

a passageway by which the swash plate chamber is in fluid communication with the compression chamber, through which the fluid in the swash plate chamber flows to the compression chamber;

at least one positioned in the swash plate chamber such that fluid flows through said inlet port, into the swash plate chamber and over said bearing, through said passageway, and into the compression chamber;

a swash plate disposed in the swash plate chamber; and a gimbal arm coupled to said swash plate by at least one of said bearings.

6. A compressor comprising:

a cylinder block at least partially defining a comprsssion chamber;

a swash plate housing mounted adjacent to said cylinder block, said swash plate housing at least partially defining a swash plate chamber;

a fluid inlet port in said swash plate housing through which fluid enters the swash plate chamber without passing through any part of an cylinder block;

a passageway by which the swash plate chamber is in fluid communication with the compression chamber, through which the fluid in the swash plate chamber flows to the compression chamber;

at least one bearing positioned in the swash plate chamber such that fluid flows through said inlet port, into the swash plate chamber and over said bearing, through said passageway, and into the compression chamber;

a swash plate disposed in the swash plate chamber; and a piston coupled to said swash plate by at least one of said bearings. said bearing, through said passageway, and into the compression chamber.

7. The compressor as claimed in claim 6, wherein said bearing comprises a flange having an aperture therein.

8. A compressor, comprising:

a cylinder block at least partially defining a compression chamber and having at least one piston channel therein;

a swash plate housing mounted adjacent to said cylinder block, said swash plate housing at least partially defining a swash plate chamber;

a fluid inlet port in said swash plate housing through which fluid enters the swash plate chamber without passing through any part of any cylinder block;

a passageway by which the swash plate chamber is in fluid communication with the compression chamber, through which the fluid in the swash plate chamber flows to the compression chamber;

a shaft disposed in said swash plate housing and cylinder block;

a swash plate mounted on said shaft;

at least one piston coupled to said swash plate and disposed in said at least one piston channel and slidable therein; and an actuator said swash plate, such that said actuator, in a first position, exerts a force on said swash plate appropriate to retain said swash plate in a position perpendicular to said drive shaft, such that said at least one piston remains idle, and, in a second position, exerts a force on said swash plate appropriate to pivot said swash plate, thereby causing reciprocal motion of said at least one piston.

9. The compressor as claimed in claim 8, wherein:

said cylinder block has a fluid channel therein; and said passageway comprises the fluid channel.

10. The compressor as claimed in claim 9, further comprising a head mounted adjacent said cylinder block, wherein:

said head has an inlet channel by which the fluid channel communicates with the compression chamber; and said passageway further comprises the inlet channel.

11. The compressor as claimed in claim 8, further comprising a head mounted adjacent said cylinder block, wherein:

said head has a fluid outlet port; and said head has an outlet channel by which the compression chamber communicates with the outlet port.

12. The compressor as claimed in claim 8, wherein:

said piston has a face for contacting fluid to be compressed; and the compression chamber comprises a portion of the piston channel to which the piston face is exposed.

13. The compressor as claimed in claim 8, wherein the compressor further comprises at least one bearing positioned in the swash plate chamber such that fluid flows through said inlet port, into the swash plate chamber and over said bearing, through the passageway, and into the compression chamber.

14. The compressor as claimed in claim 13, wherein said swash plate comprises:

a rotatable inner part; and a non-rotatable outer part coupled to said inner part by at least one of said bearings.

15. The compressor as claimed in claim 13, further comprising a gimbal arm coupled to said swash plate by at least one of said bearings.

16. The compressor as claimed in claim 13, wherein said at least one piston is coupled to said swash plate by at least one of said bearings.

17. The compressor as claimed in claim 13, wherein said bearing comprises a race.

18. The compressor as claimed in claim 13, wherein said bearing comprises a ball bearing.

19. The compressor as claimed in claim 13, wherein said bearing comprises a roller bearing.

20. The compressor as claimed in claim 13, wherein said bearing comprises a flange having an aperture therein.

* * * * *